United States Patent [19]

Brant

[11] Patent Number: 5,035,092

[45] Date of Patent: Jul. 30, 1991

[54] NONSYMMETRICAL EAVESTROUGH FITTING

[75] Inventor: Anthony W. Brant, Minesing, Canada

[73] Assignee: GSW Inc., Barrie, Canada

[21] Appl. No.: 565,969

[22] Filed: Aug. 13, 1990

[51] Int. Cl.[5] ..... E04D 13/00; E02B 5/00

[52] U.S. Cl. ..... 52/11; 52/12; 248/48.1; 248/48.2; 405/118; 405/119

[58] Field of Search ..... 52/11-12; 248/48.1, 48.2; 16/87.2; 405/43, 47, 49, 118-121

[56] References Cited

U.S. PATENT DOCUMENTS

| | | | |
|---|---|---|---|
| 3,670,505 | 6/1972 | Weaver | 52/12 |
| 4,257,716 | 3/1981 | Woodrow | 52/11 |
| 4,305,236 | 12/1981 | Williams | 52/11 |

FOREIGN PATENT DOCUMENTS

| | | | |
|---|---|---|---|
| 62483 | 10/1982 | European Pat. Off. | 52/11 |

*Primary Examiner*—John E. Murtagh

*Assistant Examiner*—Deborah McGann Ripley

[57] ABSTRACT

An eavestrough fitting according to the present invention comprises a body portion of a shape generally corresponding to the eavestrough to be axially received therein, with a fitting on the interior surface including an abutment member positioned to limit the extent to which an eavestrough is axially inserted within the fitting. Retaining tabs extend above and project outwardly from the abutment member and define a slot like opening between the retaining tabs and interior surface of the fitting into which an end portion of the eavestrough is inserted and retained. A sealing arrangement is moulded to the fitting on the interior surface of the fitting in front of the retaining tabs and forms an effective seal between the lower surface of the eavestrough and the eavestrough fitting. This fitting allows for an effective method of joining lengths of eavestrough, whether they be symmetrical or nonsymmetrical, and positively retain the eavestrough within the fitting. This system is designed to overcome problems associated with the solvent based adhesive.

11 Claims, 2 Drawing Sheets

FIG.1.
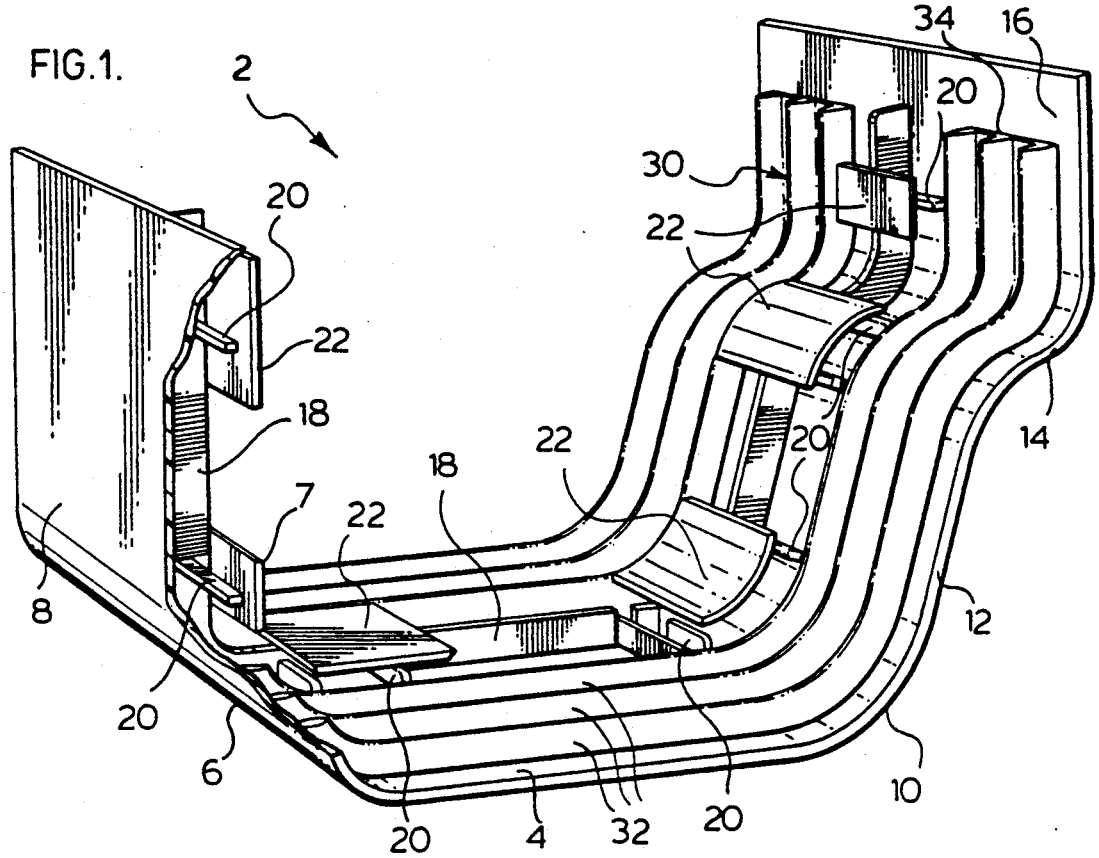
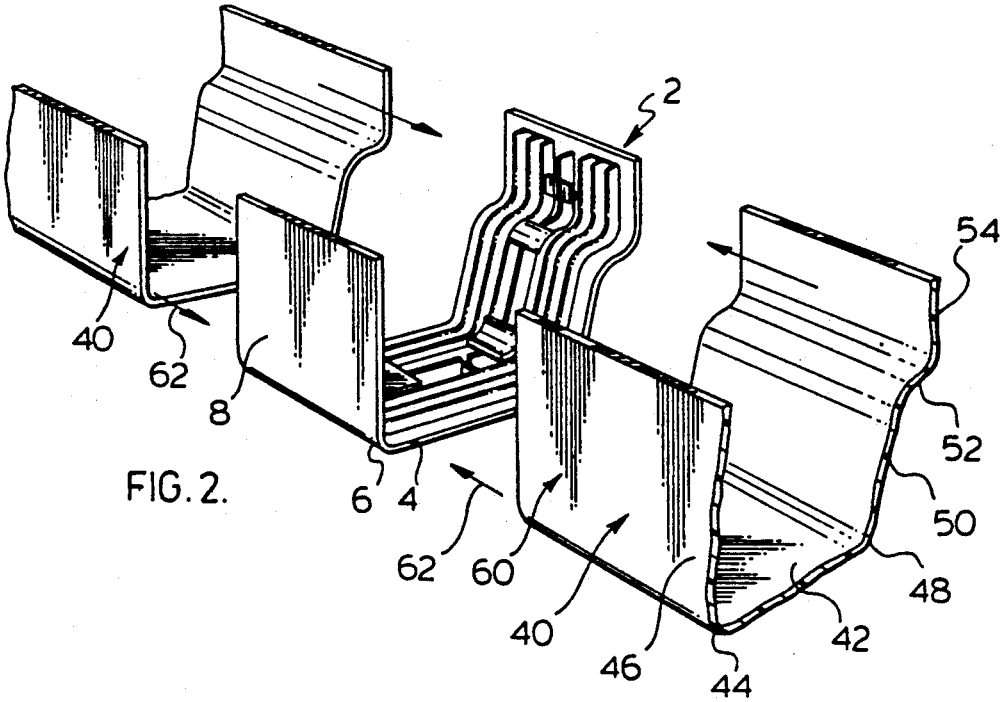
FIG. 2.

NONSYMMETRICAL EAVESTROUGH FITTING

FIELD OF THE INVENTION

The present invention relates to eavestrough fittings and particularly eavestrough fittings for use in association with nonsymmetrical eavestroughing.

BACKGROUND OF THE INVENTION

Plastic eavestrough systems are normally based on a solvent seal where the eavestrough is permanently secured to the fitting or are based on a dynamic seal where the eavestrough is free to move within the fitting. In systems having a dynamic seal, resilient sealing members are adhered to the fitting. The most common method of securing of these seals is to mold the gasket member directly on the plastic fitting. With solvent base systems, the eavestrough is permanently secured to the fitting by means of a solvent, such that a permanent bond between the eavestrough and the fitting occurs. Unfortunately, with plastic eavestrough fittings, thermal expansion of the eavestrough can be considerable and expansion and contraction must be taken into account, based on the extremes between summer and winter conditions. In a dynamic seal system, such expansion is accommodated due to the fitting which can accept the movement of the eavestrough, however, in a solvent system, separate expansion and contraction units must be inserted. Failure to insert such expansion and contraction units in a solvent base eavestrough system will result in breaking of certain solvent bonds and resulting in leaking of the joints.

The use of nonsymmetrical eavestroughing, such as a "K" style eavestrough when manufactured in plastic, has used a solvent based system, as dynamic seals have generally been confined to symmetrical type eavestrough systems.

There remains a need to provide an effective system for securing of nonsymmetrical eavestroughing by means other than a solvent seal.

SUMMARY OF THE INVENTION

An eavestrough fitting for a nonsymmetrical eavestrough comprises a generally flat bottom curving upwardly at a rear edge to a generally upright back portion and at a front edge, curving upwardly into an angled first section and an upright second section joined to the first section by a curved section. A plurality of sealing ribs generally follow a vertical section of the eavestrough fitting and are located on the interior surface of the fitting. A plurality of retaining tabs extend over the interior surface of the fitting and define a slot like opening for receiving an end of a length of eavestrough. The ribs are of a resilient material and cooperate with the tabs to snuggly retain an eavestrough end in said fitting when inserted therein.

The present invention is also directed to combination of the eavestrough fitting described above when a length of eavestrough has been received within in the fitting.

It has been found with the fitting as described above that a satisfactory stationary seal is accomplished, such that nonsymmetrical eavestroughing can be joined in end to end relationship by such a fitting or a fitting can close one end of a length of eavestrough. Furthermore, it has been found with this fitting that, if necessary, and in addition to normal techniques for accommodating expansion and contraction of such eavestrough fittings, the eavestrough fitting will allow for some movement of the eavestrough therewithin while maintaining a seal. Such would not be the case in a solvent welded system.

BRIEF DESCRIPTION OF THE DRAWINGS

Preferred embodiments of the invention are shown in the drawings, wherein:

FIG. 1 is a perspective view of an eavestrough fitting;

FIG. 2 is a partial perspective view showing two lengths of about to be connected in end to end relationship by means of an eavestrough fitting;

DETAILED DESCRIPTION OF THE PREFERRED EMBODIMENTS

Figure 3:
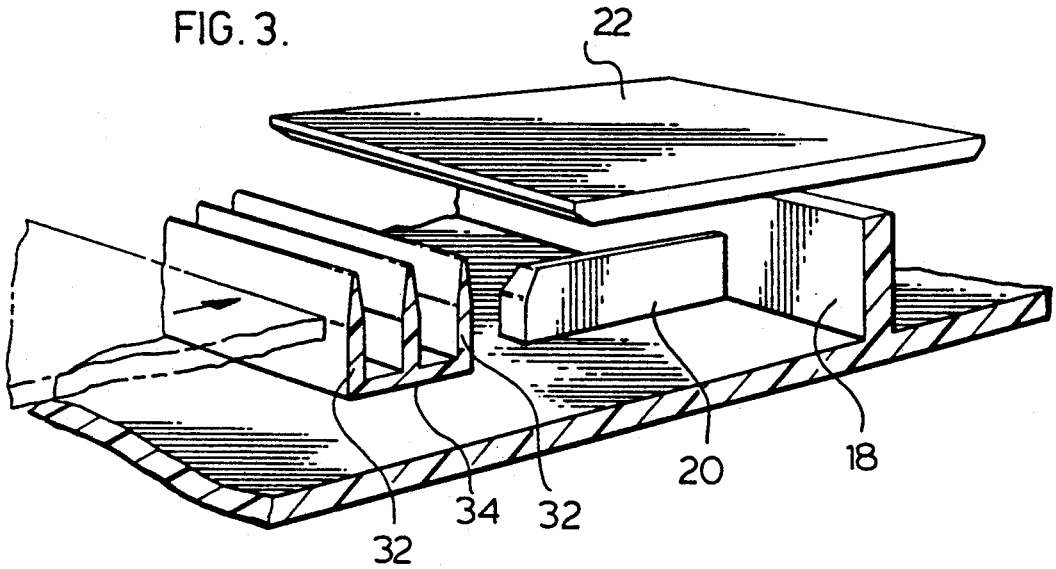
FIG. 3 is a partial perspective showing the relationship between the seal members used in the eavestrough fitting an end of a length of eavestrough about to be inserted therein.

The eavestrough fitting 2 is for use with the "K" style plastic eavestroughing generally shown as 40. This type of eavestroughing is a nonsymmetrical eavestrough as opposed to symmetrical eavestroughing, as generally shown in our U.S. Pat. No. 4,257,716. The eavestrough fitting 2 includes a flat bottom 4 which curves upwardly at the rear edge of the flat bottom at 6 and merges with an upright rear edge 8. The flat bottom 4 at the forward face again includes a curved portion, generally shown as 10, which merges the flat bottom with an angled first section 12. A further curved section 14 joins the angled first section 12 with an upright second section 16.

Figure 4:
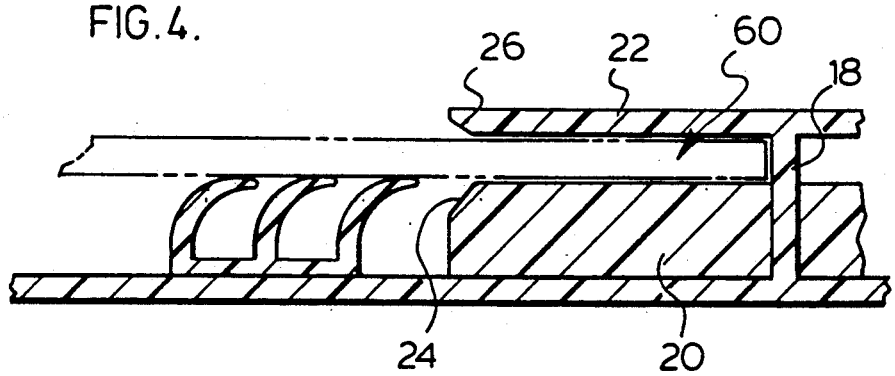
FIG. 4 is a sectional view showing the deformation of the seal members when a length of eavestrough has been inserted within the fitting.

Interior to the fitting 2 is an abutment face 18 which defines a stop for inserting of an eavestrough end, as generally shown in FIG. 4. The abutment face 18 has associated therewith spacers 20 which are secured on the interior surface of the eavestrough fitting. These spacers serve to partially separate end 60 of the eavestrough section 40 which is inserted within a fitting, as generally shown in FIG. 4. The spacers 20 cooperate with the retaining tabs 22 to snuggly engage the end 60 of an eavestrough section 40 which has been inserted within the fitting 2. Ease of insertion of the end 60 of the eavestrough section 40 into the fitting 2 is accomplished due to the taper 24 provided on each of the spacers 20 in combination with the taper face 26 associated with each of the tabs 22. Taper face 24 and taper face 26 provide a guide arrangement for allowing insertion of the eavestrough section within the fitting 2.

Retaining tabs 22 are supported by the abutment face 18 and project above the flat bottom 4 of the eavestrough fitting and cooperate with the spacer bars 24 retaining of an end of a section of eavestrough. The tabs are integrally moulded with the eavestrough fitting and accurately position a section of eavestrough when inserted within the fitting.

Sealing ribs 30 are positioned exterior to the spacers 20 and the retaining tabs 22 and are normally directly moulded on the fitting after the fitting has itself been moulded. The sealing ribs 30 are of an easily deformable resilient type material and provide a wiper type seal with the lower surface of a section of eavestrough, as generally indicated in FIG. 4. The sealing ribs 30 include three separate wedge shaped ribs 32 interconnected by base portion 34 which is directly secured to the interior surface of the fitting. The base provides the seal with the interior surface of the fitting and the wedge shaped ribs provide a wiper type seal with the exterior surface of the eavestrough inserted within the fitting.

The eavestrough, generally shown as 40, also has a flat bottom 42, a curved joining section 44 for merging the flat bottom with the upright rear wall, a curved section 48 at the front of the flat bottom which provides a transition between the flat bottom 42 and the first angled section 50, and a curved section 52 joining the angled first section 50 with the upright second section 54. The eavestrough 40 is inserted within the fitting, generally shown as 2, by an axial sliding type motion, generally indicated as 62.

It has been found with the eavestrough fitting and eavestrough, generally shown in the drawings, that the retaining tabs 22 in combination with the spacer bars 20 provide firm engagement of the eavestrough end 60 when inserted within the fitting, whereby the eavestrough section and fitting move as one unit. The seals on the interior surface of the fitting exterior to the spacer bars and the tabs provide an excellent sealing arrangement, with the spacers 20 serving to protect or control the extent to which the wiper wedged shaped ribs 32 are deformed. This is best illustrated in FIG. 4 where it can be seen that the spacers 20 protect the individual wedged shaped ribs 32 whereby an effective wiper seal is accomplished due to the gentle curving of the wedged shaped ribs 32 and a larger area of contact. The wedged shaped ribs are not exposed to the same deformation forces that would be present if the spacer bars 20 were not present, and thus, the spacer bars serve to protect the wedged shaped ribs and allow them to perform their wiper type seal which, due to this particular relationship, has an extended life.

It is preferred that the eavestrough fitting and the end of eavestrough 60 are essentially locked, however, if necessary and a contractive force is exerted on the eavestrough, such as would be common during extreme cold conditions, some movement can occur between the fitting and the eavestrough section while still maintaining the seal and still accommodating the opposite expansion when the extreme winter conditions are removed. Therefore, although expansion is normally accommodated by other members of the system, the fitting in accordance with the present invention does allow for contraction of the eavestrough section, if necessary, and also allows for the expansion of the eavestrough section when such conditions which cause the contraction are removed. Thus, the present system, due to the unique fitting, accommodates limited contraction and the subsequent expansion of the eavestrough section, if necessary. This arrangement is quite acceptable, in that eavestrough systems of this type are generally installed by the home handyman during mild conditions such as spring and summertime and thus, abutment of the eavestrough section within the fitting, in the manner of FIG. 4, still allows this contraction and further expansion. For example, if for some reason the contraction of the eavestrough section is impaired or limited, some contraction of the eavestrough section within the fitting can be accomplished ,as the eavestrough section can partially withdraw within the slot between the tabs 22 and the spacer bars 20 and the wedged shaped ribs 32 will still maintain a wiper type seal with the lower surface of the eavestrough section.

The present system can also accommodate expansion by increasing the size of the retaining tabs 22 and the slot defined between the retaining tabs and underlying base or sides of the fitting. With this arrangement, the eavestrough is not fully inserted to the back of the slot to accommodate expansion of the eavestrough.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An eavestrough fitting for a nonsymmetrical eavestrough comprising a generally flat bottom curving upwardly at a rear edge to a generally upright back portion and at a front edge curving upwardly into an angled first section and an upright second section joined to said first section by a curved section, a plurality of sealing ribs following a vertical section of the eavestrough fitting and on the interior surface of the fitting, a plurality of retaining tabs extending over said interior surface of said fitting and defining a slot like opening for receiving an end of a length of eavestrough, said ribs being of a resilient material and cooperating with said tabs to snuggly retain said eavestrough end in a fitting when inserted therein.

2. An eavestrough fitting for a nonsymmetrical eavestrough as claimed in claim 1 wherein said fitting further includes bottom spacers associated with said tabs providing a bottom support which cooperates with said ribs-

3. An eavestrough fitting for a nonsymmetrical eavestrough as claimed in claim 2 wherein said fitting includes an abutment face which limits the extent to which an eavestrough can be inserted within said fitting and which supports said tabs.

4. An eavestrough fitting for a nonsymmetrical eavestrough as claimed in claim 3 wherein said tabs project over said bottom spacers and stop before said ribs.

5. An eavestrough fitting for a nonsymmetrical eavestrough as claimed in claim 4 wherein said ribs include at least two wedge shaped wiper members which readily deform and conform to the lower surface of an eavestrough inserted therein.

6. An eavestrough fitting for a nonsymmetrical eavestrough as claimed in claim 5 wherein there is a tab associated with each curved portion of said fitting and at least one tab associated with each planar section of the eavestrough fitting.

7. An eavestrough fitting for a nonsymmetrical eavestrough as claimed in claim 6 wherein said tabs associated with said curved portions are of a shape generally corresponding to the portion of the eavestrough fitting therebelow.

8. An eavestrough fitting for a nonsymmetrical eavestrough as claimed in claim 8 wherein said fitting is of a shape for receiving a K style eavestrough.

9. In combination an eavestrough fitting of an injection molded material and a length of eavestrough made of an extruded plastic wherein said fitting is adapted to receive an end of the eavestrough and frictionally retain said end and provide a seal between the bottom of the eavestrough and said fitting, said fitting being of a nonsymmetrical cross section and including a plurality of retaining tabs extending over said interior surface of said fitting and defining a slot like opening sized to receive the end of said length of eavestrough, said ribs being of a resilient material and cooperating with said tabs to snuggly retain said eavestrough end in said fitting when received in said slot like opening.

10. In combination as claimed in claim 9 wherein said fitting further includes bottom spacers associated with said tabs providing a bottom support which cooperates with said ribs for retaining said eavestrough end.

11. In combination as claimed in claim 10 wherein said fitting includes an abutment face which limits the extent to which an eavestrough can be inserted within said fitting and which supports said tabs at a position above said interior of said fitting.

* * * * *